US006027401A

United States Patent [19]

Saito et al.

[11] Patent Number: 6,027,401

[45] Date of Patent: Feb. 22, 2000

[54] HEADSTOCK OF A POLISHING MACHINE

[75] Inventors: Hideo Saito, Numazu; Fumitaka Ito, Fuji, both of Japan

[73] Assignee: Toshiba Machine Co., Ltd., Tokyo, Japan

[21] Appl. No.: 08/955,701

[22] Filed: Oct. 23, 1997

[30] Foreign Application Priority Data

Oct. 25, 1996 [JP] Japan ..... 8-284145
Oct. 31, 1996 [JP] Japan ..... 8-290570

[51] Int. Cl.[7] ..... B24B 7/22

[52] U.S. Cl. ..... 451/398; 451/288; 451/388

[58] Field of Search ..... 451/398, 388, 451/288, 41, 287

[56] References Cited

U.S. PATENT DOCUMENTS

| | | | |
|---|---|---|---|
| 4,270,314 | 6/1981 | Cesna | 451/288 |
| 5,423,558 | 6/1995 | Koeth et al. | 451/388 |
| 5,441,444 | 8/1995 | Nakajima | 451/288 |
| 5,476,414 | 12/1995 | Hirose et al. | 451/288 |

FOREIGN PATENT DOCUMENTS

| | | |
|---|---|---|
| 61-4662 | 1/1986 | Japan . |
| 61-2567 | 2/1986 | Japan . |
| 61-25768 | 2/1986 | Japan . |

*Primary Examiner*—Robert A. Rose
*Attorney, Agent, or Firm*—Pillsbury Madison & Sutro LLP

[57] ABSTRACT

The present invention provides a headstock of a polishing machine, having a simple structure and capable of tracing a pad surface. The headstock of the present invention is formed of a spindle, a holder plate, a spherical bearing, and a plate spring. The holder plate is connected to a lower end portion of the spindle via the spherical bearing and the plate spring. A workpiece is attached to the lower surface of the holder plate. The spherical bearing has a center of tilting movement on a rotation axis of the spindle. The holder plate has a balance plate. The center of gravity of the holder plate including the balance plate coincides with the center of tilting movement of the spherical bearing. The plate spring has an axisymmetric shape. More specifically, the plate spring has an opening portion at the center and a plurality of arm portions extending to the outer periphery in the diameter direction. The plate spring is connected to the lower end of the spindle by use of first fitting holes which are formed along the inner periphery, and the plate spring is also attached to the holder plate by use of second fitting holes which are formed in the distal end of the plate spring. The first and second fitting holes are respectively located on small- and large-diameter circles which are concentrically arranged around the rotation axis of the spindle.

7 Claims, 8 Drawing Sheets

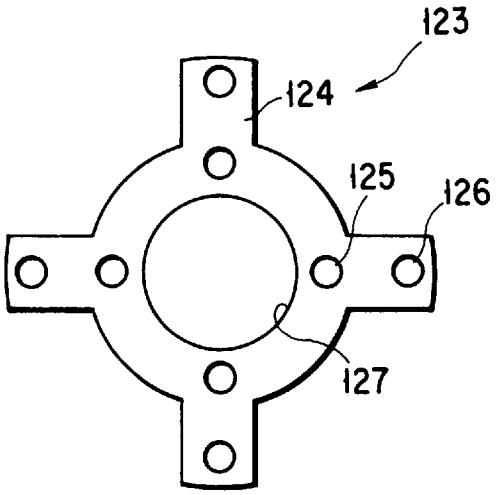
FIG. 13A
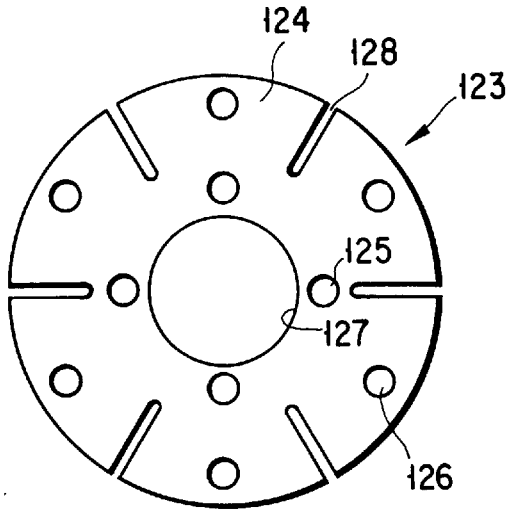
FIG. 13B
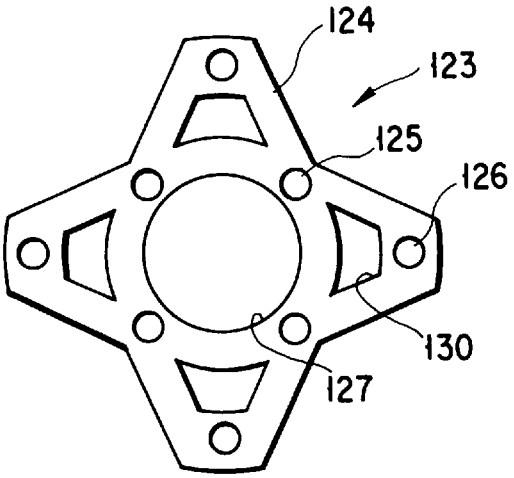
FIG. 13C
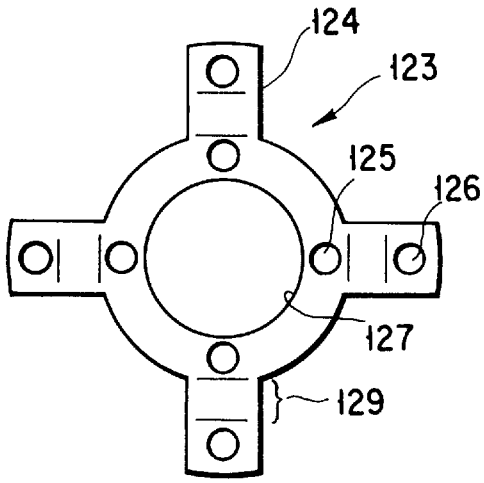
FIG. 13D
FIG. 13E
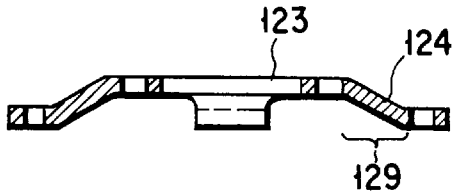

HEADSTOCK OF A POLISHING MACHINE

BACKGROUND OF THE INVENTION

The present invention relates to a structure of a headstock of a polishing machine for use in polishing the surfaces of flat-plate substrates, such as semiconductor substrates, magnetic disks and glass substrates.

A structure of a headstock of a conventionally-used polishing machine is schematically shown in FIG. 15.

A polishing pad 7 is adhered to an upper surface of a turntable 6. The headstock 10 is positioned above the turntable 6 so as to face it. The headstock 10 is essentially formed of a spindle 4 and a holder plate 3. The holder plate 3 is connected to the lower end of the spindle 4. A thin disk-form workpiece 2 is attached to the lower surface of the plate 3 with a soft pad 5 interposed between them.

The surface of the workpiece 2 is ground by pressing the workpiece 2 against the polishing pad 7 while the turntable 6 and the headstock 10 are separately rotated, and a polishing medium or slurry is supplied from a nozzle 8 to the polishing pad 7 placed on the turntable 6.

If the surface of the polishing pad 7 (hereinafter, referred to as "pad surface") is completely flat, the resultant ground surface of the workpiece will be completely flat. However, in fact, the polishing pad is non-uniform in thickness by nature. For example, a commercially available polishing pad varies several tens of micrometers in thickness even in the same pad. To improve the flatness of the polishing pad, dressing is applied to the polishing pad prior to polishing. However, even if dressing is applied, about 10 $\mu$m difference in thickness still remains. Furthermore, the polishing pad is deformed by frictional heat or the influence of pressure. As a result, the workpiece 2 is not in uniform contact with the pad surface. The resultant ground surface of the workpiece 2 is degraded in flatness.

To reduce the aforementioned non-uniform contact of the workpiece with the pad surface, the following structure has been proposed. In this structure, the holding plate is not directly fixed to the lower end of the spindle. It is fixed to the lower end of the spindle via a tilting mechanism, thereby enabling the headstock to trace an uneven pad surface. Such a structure (shown in FIG. 9A) is disclosed, for example, in Jpn. Pat. Appln. KOKAI Publication Nos. 61-25767, 61-25768, and 61-4662.

A flange 78 having a spherical seats at the lower side, is provided at a lower end of a spindle 4. A hemispherical body 79 moving along the spherical seat is placed under the flange 78. A holder plate 12 is attached to the lower side of the hemispherical body 79. To transmit rotation torque from the spindle 4 to the holder plate 12, they are connected to each other via an Oldham coupling (Jpn. Pat. Appln. KOKAI Publication No. 61-25767), bellows (Jpn. Pat. Appln. KOKAI Publication No. 61-25768), or three links (Jpn. Pat. Appln. KOKAI Publication No. 61-4662).

However, in the aforementioned headstock, pressure is transmitted from the spindle 4 to the holder plate 12 via the sliding face, which is between the spherical seat and the hemispherical body 79. This means that the tilting movement of the holder plate may be disturbed by friction force at the sliding face. In addition, the center of gravity of the tilting portion (consisting of holder plate 12 and a hemispherical body 79) is far away from the center of tilting in a headstock of this type. Consequently, if the holder plate 12 is rotated, a centrifugal force works on the holder plate 12 and accelerates its tilting, with the result that the pad surface cannot be traced desirably. The influence of the centrifugal force cannot be negligible when a highly flat ground surface is desired.

BRIEF SUMMARY OF THE INVENTION

The present invention has been made to overcome the aforementioned problems. An object of the present invention is to provide a headstock of a polishing machine capable of suppressing an influence of a frictional force (generated in a sliding portion) to a minimum and excellent in tracing a polishing pad surface.

A headstock of a polishing machine of the present invention for holding and rotating a flat-plate workpiece, comprising

- a spindle connected to a rotation driving mechanism;
- a supporting plate connected to a lower end of the spindle;
- a holder plate arranged in parallel to the supporting plate on a lower side of the supporting plate, and having the workpiece on a lower side of the holder plate; and
- connecting means for connecting the holder plate to the supporting plate, the connecting means having a rigidity in a rotation direction of the spindle and being capable of elastically deforming in a direction perpendicular to the surface of the workpiece.

According to the headstock of the present invention, the connecting means has not only a function of transmitting rotation torque from the supporting plate to the holder plate but also a function of tilting the holder plate by elastic deformation in a perpendicular direction to the surface of the workpiece. Since the headstock of the present invention does not tilt by sliding, smooth tilting can be made compared to a conventionally-used headstock. It is excellent in tracing the pad surface. Hence, the headstock of the present invention attains highly-accurate surface polishing.

The connecting means is formed, for example, of a plurality of plate springs. These plate springs are arranged at equal intervals on the circumference of a circle having a center on a rotation axis of the spindle. A longitudinal direction of each of the plate springs is in parallel to a tangent line of the circle. A thickness direction of each of the plate springs is in perpendicular to the surface of the workpiece. An end of the plate spring is fixed on the supporting plate, whereas the other end of the plate spring is fixed on the holding plate.

Alternatively, the connecting means may be formed of a plurality of composite members. Each of the composite member is formed of a rigid member and elastic bodies which are provided on both ends of the rigid member. The composite members are arranged at equal intervals on the circumference of a circle having a center on a rotation axis of the spindle. One end of the rigid member is connected to the supporting plate via one of the elastic bodies, whereas the other end of the rigid member is connected to the holder plate via the other elastic bodies.

Alternatively, the connecting means may be formed of a ring-form plate spring. The spring is fixed on the supporting plate at positions, which are arranged at equal intervals on the circumference of a circle having a center on a rotation axis of the spindle. The plate spring is also fixed on the holder plate at positions which are arranged at a predetermined distance from the former positions in the circumference direction.

According to the headstock of the present invention constructed as described above, pressure for pushing the workpiece against a polishing pad placed on a turntable is transmitted to the holder plate via the connecting means. If a large pressure is required, it is necessary to use the connecting member having a large spring coefficient. However, the larger the spring coefficient, the larger the resistance to the tilting. As a result, the ability of the headstock for tracing the pad surface is degraded. Hence, if a large pressure is required, it is necessary to interpose a pressure transmitting block (for transmitting the pressure from the supporting plate to the holder plate) between the supporting plate and the holder plate. By this construction, a large pressure can be applied to the workpiece without using an elastic body having a large spring coefficient. At the same time, smooth tilting can be ensured.

The pressure transmitting block is formed of an elastic body such as rubber. The block is arranged on an extension line of a rotation axis of the spindle.

The pressure transmitting block is preferably formed of a rigid ball such as a steel ball, and also arranged on an extension line of a rotation axis of the spindle. Spherical seats are formed at the center of a lower surface of the supporting plate and at the center of an upper surface of the holder plate. The rigid ball is placed in a space surrounded by the spherical seats.

Furthermore, the center of gravity of the holder plate is preferred to-coincide with the center of the ball by providing a balance plate on the holder plate. By the presence of the balance plate, it is possible to eliminate the influence of centrifugal force working upon the holder plate when the holder plate tilts.

In another aspect of the present invention, the headstock of a polishing machine, for holding and rotating a flat-plate workpiece comprises;

a spindle connected to a rotation driving mechanism;

a spherical bearing connected to a lower end portion of the spindle and having a center of tilting on a rotation axis of the spindle;

a holder plate connecting to the spindle via the spherical bearing and having the workpiece on the lower surface of the holder plate; and a plate spring having first fitting holes arranged in the circumference of a first circle, which has a center on a rotation axis of the spindle, and second fitting holes arranged in the circumference of a second circle, which is concentric with the first circle, having a larger diameter than the first circle. The plate spring is connected to the spindle via the first fitting holes. It is also connected to the holder plate via the second fitting holes.

According to the headstock of the present invention constructed as mentioned above, the holder plate is connected to the spindle via the spherical bearing and the plate spring. Therefore, the holder plate tilts around the center of tilting of the spherical bearing. At the same time, rotation torque is transmitted from the spindle to the holder plate via the plate spring.

If the connecting portions of the spindle to the plate spring and the connecting portions of the plate spring to the holder plate are arranged in an axisymmetric shape by using the plate spring constructed as described above, the shape of the coupling portion, which is formed of the plate spring and the spherical bearing, can be simplified.

The rotation torque transmitted via the plate spring is limited. If the rotation speed of the headstock in polishing is set to virtually the same as that of the turntable, the rotation torque is transmitted also from the turntable to the holder plate via the workpiece. Consequently, the rotation torque to be transmitted from the spindle to the holder plate can be reduced. This means that a thin plate spring (or having a small cross sectional area) can be used. In this way, it is possible to attain the headstock capable of tilting easily by small foreign-force and tracing the pad surface.

It is preferable that a balance plate be provided on the holder plate to set a center of gravity of the holder plate including the balance plate inside a space surrounded by the spherical seats of the spherical bearing. If so, it is possible to reduce the centrifugal force or the restoring force which is generated due to the weight of the holder plate when the holder plate tilts. As a result, the resistance which works when the holder plate tilts is successfully reduced, enabling the headstock to trace the pad surface, more desirably. In particular, maximum effects can be produced when the center of gravity coincides with the center of tiling of the spherical bearing.

The headstock according to the present invention has a relatively simple structure. Therefore, the head stock can be miniaturized and lightened. The headstock thus obtained exhibits excellent tilting movement. As a result, it is possible to obtain a miniaturized and light-weight polishing machine.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

FIG. 13A is a plan view of a plate spring to be used in the headstock according to the present invention;

FIG. 13B is a plan view of another plate spring to be used in the headstock according to the present invention;

FIG. 13C is a plan view of another plate spring to be used in the headstock according to the present invention;

FIG. 13D is a plan view of still another plate spring to be used in the headstock according to the present invention;

FIG. 13E is a cross-sectional view of the plate spring shown in FIG. 13D;

DETAILED DESCRIPTION OF THE INVENTION

Now, embodiments of the headstocks of a polishing machine according to the present invention will be explained with reference to the accompanying drawings.

Embodiment 1

Figure 1:
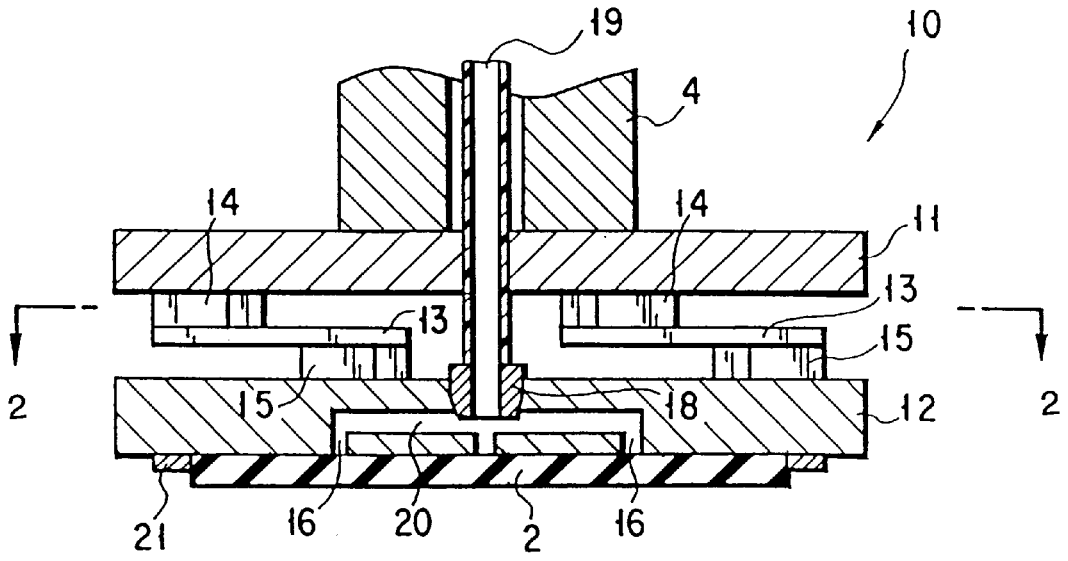
FIG. 1 is a cross-sectional view of a headstock according to the present invention.

A cross-sectional view of a first embodiment of the headstock of a polishing machine according to the present invention is shown in FIG. 1.

A headstock 10 essentially comprises a spindle 4, a supporting plate 11, a holder plate 12, and plate springs 13. The plate springs 13 connect these components with each other. The supporting plate 11 (disk form) is fixed to a top of the spindle 4. The holder plate 12 (disk form) is fixed to the lower surface of the supporting plate 11 with the plate springs 13 interposed between them. A workpiece 2 (thin disk form) is adsorbed to the lower surface of the holder plate 12. Notice that the centers of the supporting plate 11 and the holder plate 12 are on the extension line of the rotation axis of the spindle 4.

The workpiece 2 is adsorbed to the lower surface of the holder plate 12 by using a vacuum chuck. A plurality of adsorption holes 16 are formed in the lower surface of the holder plate 12. The adsorption holes 16 are connected to a pipe 19 by way of a passage 20 (formed inside the holder plate 12) and a coupling 18. The pipe 19 is passed through the center portion of the spindle 4. The workpiece 2 is adsorbed to the holder plate 2 by evacuating adsorption holes 16 through the pipe 19, whereas the workpiece 2 is removed by sending pressurized air to the adsorption holes 16 through the pipe 19. It should be noted that a flexible tube is used as the pipe 19 so as not to prevent the tilting movement of the holder plate 12. A guide 21 is formed on the lower surface of the holder plate 12 and along the periphery of the workpiece 2. The horizontal position of the workpiece is restricted by the guide 21. The center of the adsorbed workpiece 2 coincides with the center of the spindle 4.

In this embodiment, the holder plate 12 is attached to the supporting plate 11 by four plate springs 13. To be more specific, one end of each of the plate springs is fixed to the seat 14 formed on the lower surface of the supporting plate 11. Whereas, the other end of each of the plate springs is fixed to the seat 15 formed on the upper surface of the holder plate 12. Rotation torque from the spindle 4 is transmitted to the holder plate 12 by way of the plate springs 13. By means of these plate springs 13, which bend flexibly in vertical direction, the holder plate tilts, enabling the headstock to trace the pad surface.

Figure 2:
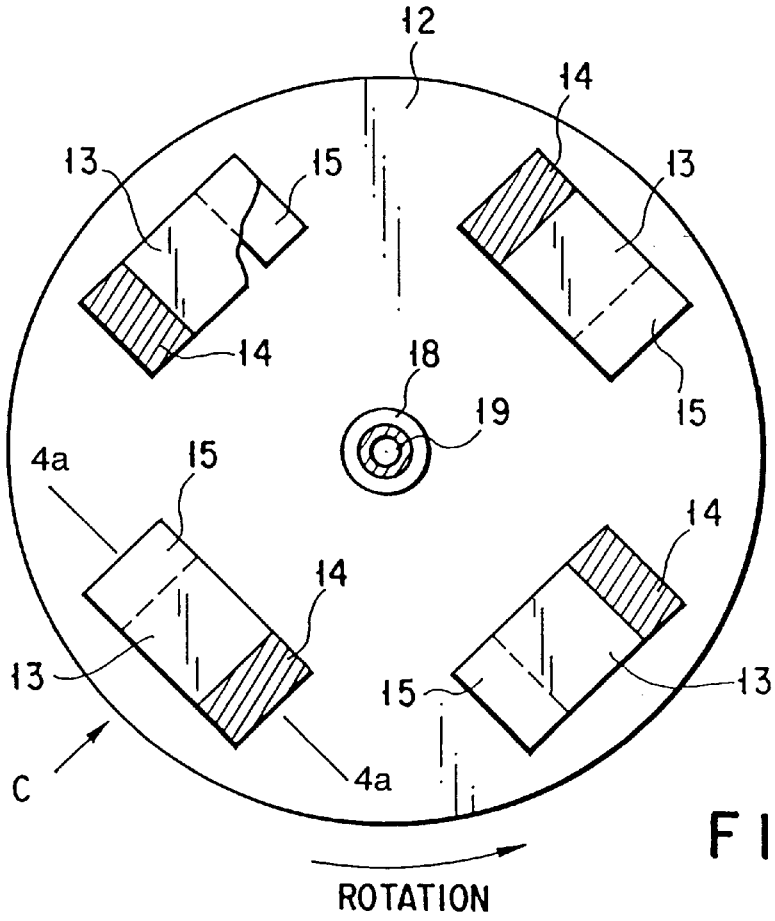
FIG. 2 is a cross-sectional view taken along the line A—A of FIG. 1 and showing how to arrange connecting members (plate springs)

The cross sectional view taken along the A—A line of FIG. 1 is shown in FIG. 2.

Four plate springs 13 are arranged at equal intervals on the circumference of a circle round the spindle 4. The longitudinal direction of each of the plate springs 13 coincides with the tangent line of the circle. The thickness direction of each of the plate springs 13 coincides with the direction perpendicular to the surface of the holder plate 12. One end of the plate spring 13 is fixed to the seat 14 formed on the side of the supporting plate 11, whereas the other end is fixed to the seat 15 formed on the side of the holder plate 12. In this manner, the holder plate 12 is attached to the supporting plate 11 with the plate springs 13 interposed between them. When no pressure is applied to the holder plate 12, the holder plate 12 is in a posture parallel to the supporting plate 11.

Although four plate springs 13 are used in the aforementioned case, any number of the plate springs 13 may be used if it is at least three. In consideration of the space required for attaching them, an appropriate number of the plate springs may fall within the range of 3 to 8.

Figure 3:
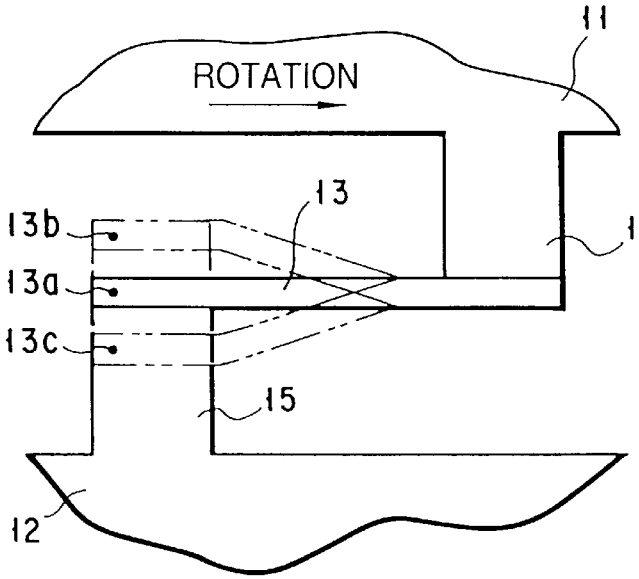
FIG. 3 is a cross-sectional view taken along the line B—B of FIG. 2 when viewed in the direction of an arrow C, and showing how a plate spring is connected to a supporting plate and a holder plate and how to move the plate spring.

The cross sectional view taken along the B—B line of FIG. 2 is shown in FIG. 3. The function of the plate spring 13 will be now explained with reference to FIG. 3.

The rigidity of the plate spring 13 in the longitudinal direction (parallel to the surface of the holder plate 12) is large. The plate spring 13 therefore transmits rotation torque from the supporting plate 11 to the holder plate 12. However, the rigidity of the plate spring 13 in the thickness direction (perpendicular to the surface of the holder plate 12) is small. Therefore, the plate spring 13 can bend flexibly in the thickness direction. Upon bending of the plate spring 13, the holder plate 12 tilts to trace the pad surface.

In FIG. 3, the plate spring 13 takes a position indicated by reference numeral 13*a* when the pad surface has a desirable flat plane. The plate spring 13 is moved into a position indicated by reference numeral 13*b* when the pad surface projects from the desirable flat plane, since the holder plate 12 is pushed upward by the projection. To the contrary, when the pad surface is depressed compared to the desirable flat plane, the plate spring 13 moves to a position indicated by reference numeral 13*c*, since the holder plate 12 is moved downward by its the own weight. Likewise, the holder plate 12 can be tilted with aid of plate spring 13 in accordance with the undulation of the pad surface. Consequently, the workpiece (attached on the lower surface of the holder plate 12) is allowed to trace the pad surface.

In the headstock shown in FIG. 1, the holder plate 12 can be tilted by use of elastic deformation of the plate spring 13. The sliding operation is not required. Since the holder plate 12 is free from the frictional force due to sliding operation, it can tilt smoothly. However, since the plate spring 13 has a rigidity in the rotation direction of the holding plate 12, the rotation torque is successfully transmitted from the supporting plate 11 to the holder plate 12 even if the holder plate 12 is tilted.

As explained in the foregoing, the holder plate 12 is attached to the supporting plate 11 through the plate springs 13. Therefore, the rotation torque can be transmitted from the supporting plate 11 to holder plate 12; at the same time, the holder plate 12 tilts relative to the supporting plate 11. Since the headstock shown in FIG. 1 has a simple structure as compared to a headstock employing a conventional mechanism of tilting. The headstock has advantageous features in manufacturing, size and cost.

Embodiment 2

Figure 4A:
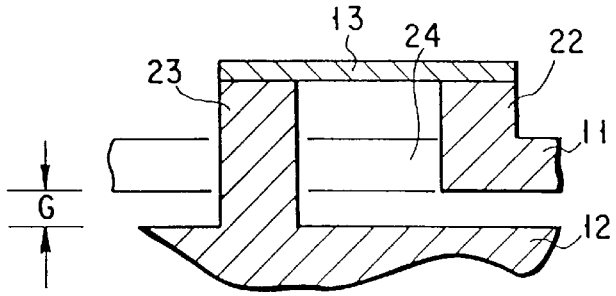
FIG. 4A is a cross-sectional view of a connecting member to be used in another headstock according to the present invention, which corresponds to the cross-sectional view taken along the B—B line of FIG. 2.
Figure 4B:
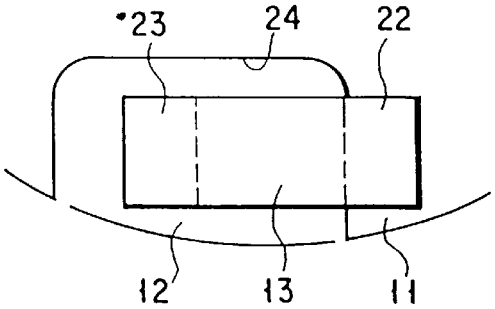
FIG. 4B is a top view of the connecting member shown in FIG. 4A.

FIG. 4A is a partial sectional view showing a second embodiment of the headstock of a polishing machine according to the present invention and corresponds to the cross section taken along the B—B line of FIG. 2. FIG. 4B is a partial top view of the plate spring 13.

This embodiment is the same as the first embodiment except for a method of attaching the plate springs 13 to the supporting plate 11 and the holder plate 12. The supporting plate 11 is provided with four cutouts 24 in the periphery. Seats 22 are provided on the upper surface side of the supporting plate 11, which correspond to portions adjacent to the cutouts 24. The seats 23 are provided on the upper surface side of the holder plate 12, which correspond to the lower side of the cutouts 24. The upper end portions of the seats 23 project upward from the supporting plate 11. The plate springs 13 are positioned above and in parallel to the supporting plate 11. One end of the plate spring 13 is fixed on the supporting plate 11 via the seat 22, whereas the other end is fixed on the holder plate 12 via the seats 23.

In this manner, the plate springs 13 are easily fixed to the supporting plate 11 and the holder plate 12. In addition, the distance G (FIG. 4A) between the supporting plate 11 and the holder plate 12 can be reduced. Furthermore, the overall height of the headstock 10 can be reduced.

The structure shown in FIG. 4A may be modified as follows: (a) The plate springs 13 are directly fixed on the upper surface of the supporting plate 11 without using the seats 22 or (b) depressed portions, are formed in the upper surface of the supporting plate 11 and the plate springs 13 are fixed to the depressed portions.

Embodiment 3

Figure 5:
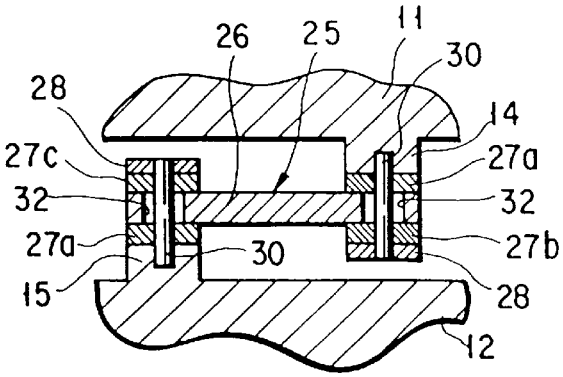
FIG. 5 is a cross-sectional view of a connecting member to be used in another headstock according to the present invention, which corresponds to a cross-sectional view taken along the B—B line of FIG. 2.

FIG. 5 is a partial sectional view of a third embodiment of the headstock of a polishing machine according to the present invention and corresponds to the cross-section taken along the B—B line of FIG. 2.

In this embodiment, connecting members of complex structure 25 are used instead of the plate springs 13 of FIG. 1. The connecting member 25 is formed of a rigid connecting plate 26 and elastic bodies 27*a*–27*d*. The elastic bodies 27*a*–27*d* are made of rubber and attached to both ends of the connecting plate 26.

Four seats 14 are respectively provided at four sites on the lower side of the supporting plate 11. Four seats 15 are respectively provided on four sites on the upper side of the holder plate 12. One end of the connecting plate 26 is fixed to the seat 14 via elastic bodies 27*a* and 27*b* which are positioned on the upper and lower sides of the end, respectively. In other words, the elastic body 27*a*, the end of the connecting plate 26, the elastic body 27*b* and a press board 28 are positioned on the lower surface of the seat 14, downwardly in that order mentioned. These are fixed on the seat 14 by a pin 30. Similarly, the other end of the connecting plate 26 is fixed to the seat 15 via the elastic bodies 27*c* and 27*d* which are positioned on the upper and lower sides of the end, respectively.

The rotation torque is transmitted from the supporting plate 11 to the holder plate 12 through the connecting plate 26. The holder plate 12 can be tilted by the elastic deformation of the elastic bodies 27*a*–27*d*. Since the connecting member 25 is formed of a rigid member in combination with the elastic bodies, a large rotation torque can be transmitted as compared to the case of using a plate spring as the connecting member.

The holes 32, which the pin 30 passes through, are provided at both ends of the connecting plate 26. In each of the holes 32, a sufficient room is formed around the pin 30 in order not to prevent the tilting of the holder plate 12. Furthermore, the room may be filled with an elastic member (not shown).

Embodiment 4

Figure 6A:
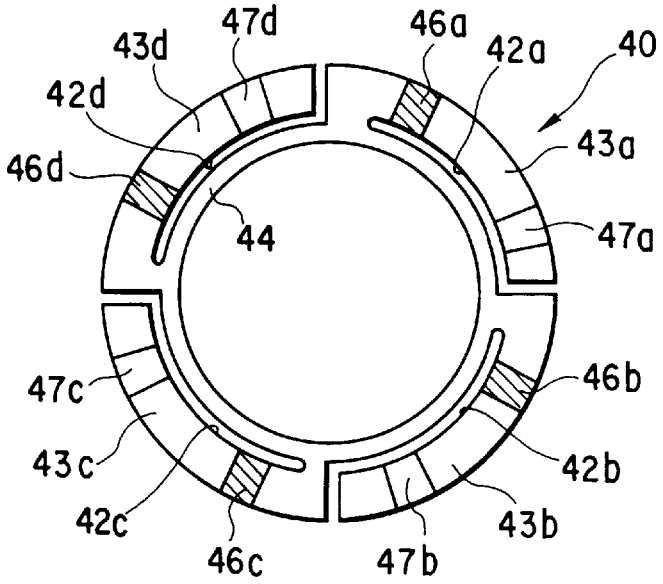
FIG. 6A is a plan view of a ring-form plate spring to be used as the connecting member in another headstock according to the present invention.

Now, we will explain a fourth embodiment of the headstock of a polishing machine according to the present invention. In FIG. 6A, a plan view of the connecting member employed in this embodiment is shown.

The connecting member shown in FIG. 6A is formed of a single-ring plate spring 40. The ring-form plate spring 40 is composed of a connecting portion 44, which is formed along its inner periphery, and four arms (43*a, b, c, d*), which extend in its outer periphery. The four arms (43*a, b, c, d*) are arranged in a rotation symmetry shape in the outer periphery of the connecting portion 44 at intervals of 90 degrees. Each arm extends along the outer periphery of the ring-form portion 44 from a base portion positioned on the outer peripheral side of the connecting portion 44. Arc-form cutouts (42*a, b, c, d*) are formed between the inner peripheral side of each arm portion and the outer peripheral side of the ring-form portion 44. The arms (43*a, b, c, d*) are fixed to the seat 14 (formed on the lower surface of the supporting plate 11 as shown in FIG. 1) at the portions (46*a, b, c, d*) near the base portion. They are fixed to the seat 15 (formed on the upper surface of the holder plate 12 as shown in FIG. 1) at the portions (47*a, b, c, d*) in the vicinity of the individual distal ends of the arms.

The rotation torque is transmitted from the supporting plate 11 to the holder plate 12 via the arm portions (43*a, b, c, d*), in the same manner as in Embodiment 1. The holder plate 12 tilts when the arm portions (43*a, b, c, d*) bend in the thickness direction.

Since the connecting member is formed of a single ring plate spring, the workability in assembling the headstock can be improved.

It is preferable that centering portions be provided at the seat 14 of the supporting plate 11 and the seat 15 of the holder plate 12 in correspondence with the arm portions (43*a, b, c, d*) and the connecting portion 44, respectively. The seat 14 and the seat 15 can be readily aligned by use of the centering portions.

Figure 6B:
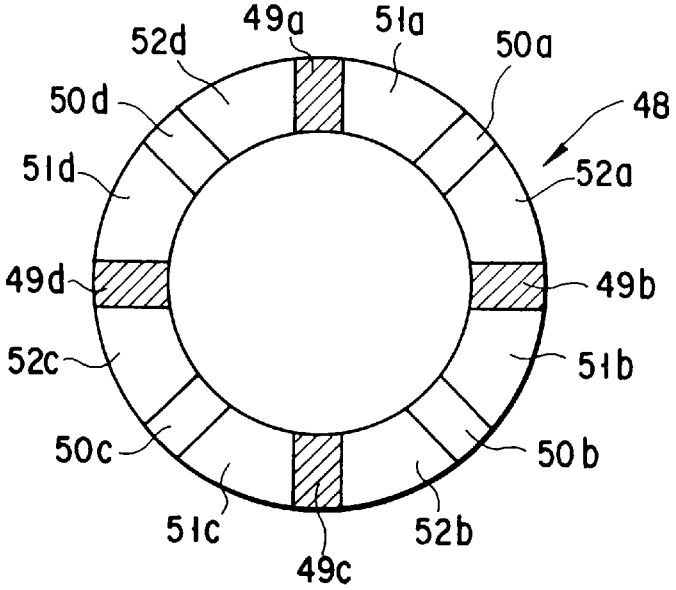
FIG. 6B is a plan view of another ring-form plate spring.

In FIG. 6B, another embodiment is shown in which the connecting member is formed of a single ring plate spring.

In this embodiment, a ring-form plate spring 48 is fixed directly on the supporting plate 11 and the holder plate 12 without forming the aforementioned arms.

The ring-form plate spring 48 is fixed on the seats 14 (formed on the lower surface of the supporting plate 11 as shown in FIG. 1) at the positions (49*a, b, c, d*) spaced at intervals of 90 degrees in the circumference. The spring 48 is also fixed on the seats 15 (formed on the upper surface of the holder plate 12 as shown in FIG. 1) at middle portions (50*a, b, c, d*) of the adjacent positions (49*a, b, c, d*).

The rotation torque is transmitted from the supporting plate 11 to the holder plate 12 via connecting portions (51*a*–51*d*, 52*a*–52*d*) between the fixing positions 49*a, b, c, d* and 50*a, b, c, d*. The holder plate 12 tilts relative to the supporting plate 11 upon bending of the connecting portions (51*a*–51*d*, 52*a*–52*d*) in the thickness direction.

As the span of the connecting portions 51*a*–51*d* and 52*a*–52*d* increases, the holder plate 12 tilts more. Hence, it is not desirable that the distance between the fixing positions 49*a*–49*d* and 50*a*–50*d* be reduced excessively.

The connecting member shown in FIG. 6B is easily formed as compared to that shown in FIG. 6A. The connecting member of FIG. 6B is suitable for use in the case where a rotation torque is small and the degree of tilting is low.

Embodiment 5

Figure 7:
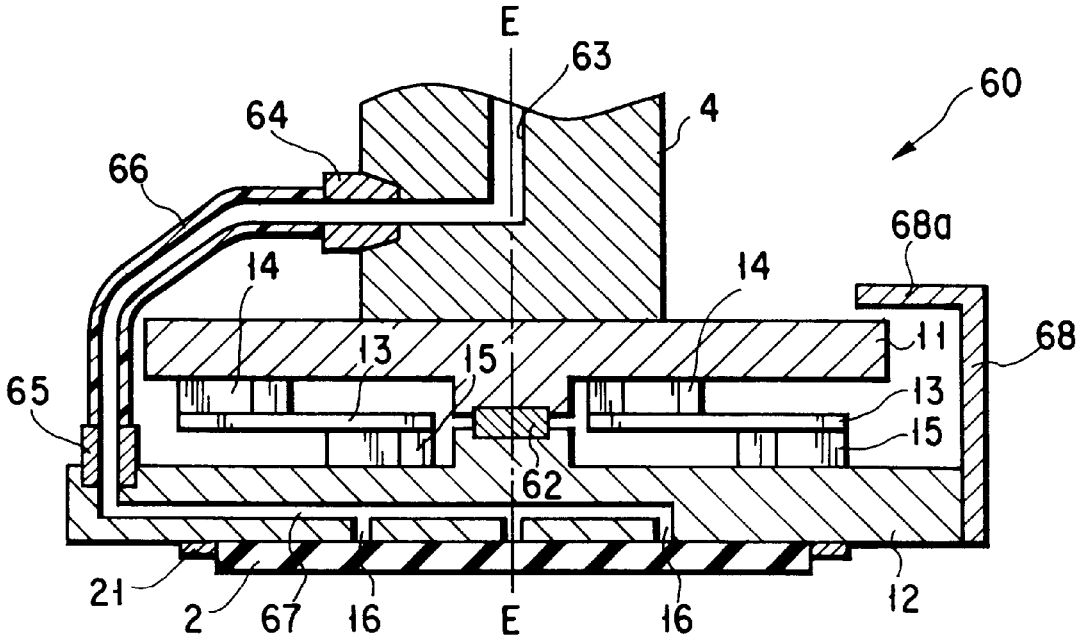
FIG. 7 is a cross-sectional view of another headstock according to the present invention employing an elastic body for transmitting pressure.

FIG. 7 shows a fifth embodiment of the headstock of a polishing machine according to the present invention.

When the workpiece 2 is ground by the machine shown in FIG. 1, the polishing pressure for the workpiece 2 against the pad surface is transmitted from the supporting plate 11 to the holder plate 12 via the plate springs 13. Hence, if the large pressure is required, the cross sectional area of the plate spring must be increased. However, if the cross sectional area of the plate spring increases, the spring coefficient of the plate spring increases, with the result that resistance of the holder plate against tilting also increases. For this reason, it is not so preferred to increase the cross sectional area of the plate spring.

Then, the supporting plate 11 is connected to the holder plate 12 via not only the plate spring 13 but also a pressure-transmitting block in this embodiment. Pressure is transmitted virtually through the pressure-transmitting block. As the pressure transmitting block, a short cylindrical elastic body 62 made of rubber is used herein. The elastic body 62 is inserted between the center portion of the lower surface of the supporting plate 11 and the center portion of the upper surface of the holder plate 12. The elastic body 62 is accordingly positioned on the rotation axis E—E of the spindle 4. The pressure is transmitted from the supporting plate 11 to the holder plate 12 via the elastic body 62. When the holder plate 12 tilts, the elastic body 62 is deformed in the tilting direction while maintaining the pressure.

Because of this constitution, a high pressure can be transmitted. At the same time, the spring coefficient of the plate spring can be lowered. Consequently, the smooth tilting of the holder plate can be ensured.

If the elastic body 62 is positioned at the center of the supporting plate 11, a vacuum pipe for adsorbing the workpiece 2 cannot be installed through the center portion of the spindle 4, as shown in FIG. 1. The passage 63, which is formed at the center of the spindle in the distal end of the spindle 4, is therefore guided to the outer periphery at a portion close to the distal end of the spindle 4, passed through a coupling 64, a pipe 66 and a coupling 65, sequentially, and connected to a passage 67 formed inside the holder plate 12. If the spring coefficient of the plate spring 13 is small, the plate spring 13 may deform over the elastic limit by the weight of the holder plate 12 when the headstock 60 is removed from a turntable (not shown). Hooks 68 having a L-shape cross section are therefore attached to the holder plate 12 in this embodiment. Excessive bending of the plate spring 13 is prevented since the upper surface of the supporting plate 11 touches the horizontal portion 68*a* of the hook 68, when the headstock 60 is removed form the turntable.

According to the headstock 60 shown in FIG. 7, pressure required for pushing the workpiece 2 against the polishing pad can be transmitted virtually by the elastic body 62. Hence, the plate spring can be designed, taking only transmission ability of the rotation torque and tilting characteristics, into consideration.

Embodiment 6

Figure 8:
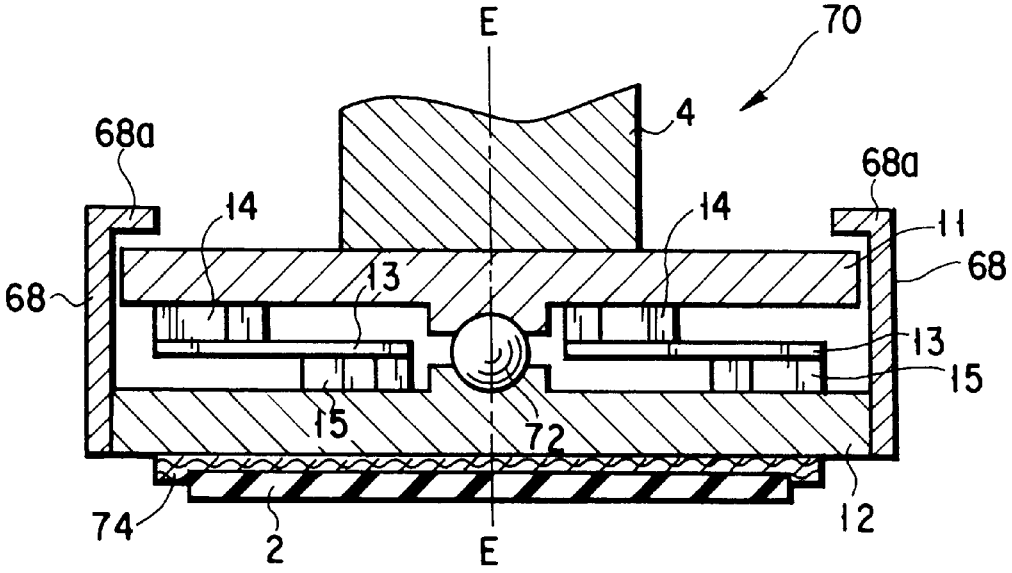
FIG. 8 is a cross-sectional view of another headstock according to the present invention employing a steel ball for transmitting pressure.

FIG. 8 shows a sixth embodiment of the headstock of a polishing machine according to the present invention.

In this embodiment, a steel ball 72 is used in place of the elastic body 62 as the pressure transmitting block. The steel ball 72 is inserted between the center portion of the lower surface of the supporting plate 11 and the center portion of the upper surface of the supporting plate 12, in the same manner as the elastic body 62 of FIG. 7. That is, the steel ball is positioned on the rotation axis E—E of the spindle 4. The pressure is transmitted from the supporting plate 11 to the holder plate 12 via the ball 72. The ball 72 slides along the spherical seats provided at the center portions of the supporting plate 11 and the holder plate 12 when the holder plate 12 tilts. Note that the spherical seat is kept smooth by applying grease or the like.

When the ball 72 is used as the pressure transmitting block, a frictional force is generated at the sliding portion between the supporting plate 11 and the holder plate 12. The frictional force disturbs the holder plate from tilting. However, since the ball 72 is present on the extension line E—E of the rotation axis of the spindle 4, the frictional force is applied to a portion quite close to the center of tilting. The moment arm of the frictional force is therefore small. As a result, the frictional force (generated at the sliding portion) has an small influence on the tilting movement.

An soft pad 74 is used in place of the vacuum chuck, to attach the workpiece 2 to the lower surface of the holder plate 12. More specifically, the soft pad 74 is attached to the lower surface of the holder plate 12. The workpiece 2 is then adsorbed to the lower surface of the soft pad 74.

Since other structures of the sixth embodiment are the same as those of the previous embodiment (FIG. 7), the explanation thereof will be omitted.

According to the headstock 70 shown in FIG. 8, the polishing pressure for the workpiece 2 against the polishing pad can be transmitted virtually by way of the ball 72. Therefore, the plate spring 13 can be designed, taking only the transmission ability of the rotation torque and tilting characteristics, into consideration, in the same way as in the previous embodiment (FIG. 7).

The headstocks shown in FIGS. 7 and 8 are compared with respect to removal rate (removal thickness per unit time) by polishing under the same conditions. As a result, it was found that the headstock of FIG. 7 (using the elastic body as the pressure transmitting block) exhibits a lower removal rate than that of FIG. 8 (using the steel ball as the pressure transmitting block) by approximately 20%. This is provably because the polishing function is lowered by temporarily-generated deformation of the elastic body 62 due to the polishing force. Therefore, when the elastic body of FIG. 7 is employed as the pressure transmitting block, it is desirable that sufficiently high pressure be applied to compensate the reduction in the removal rate.

To improve the through-put of polishing process, widely employed, in recent years, is a method of increasing the rotation speeds of the headstock and the turntable during the polishing. However, with an increase of the rotation speed, centrifugal influence upon the holder plate 12 of the headstock increases. Hence, it is necessary to consider a scheme for reducing centrifugal influence when the rotation speed is increased.

Figure 9A:
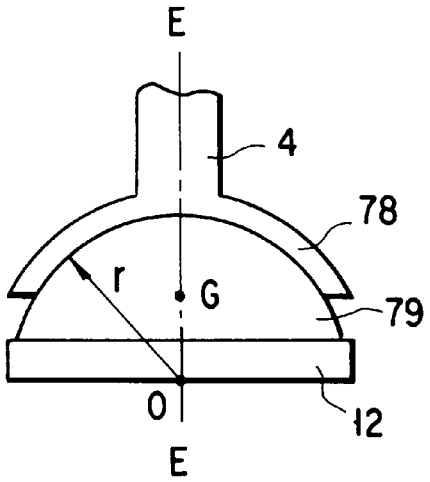
FIG. 9A (PRIOR ART)
FIG. 9A is a view for explaining the influence of centrifugal force upon the tilting portion in a conventionally-used headstock.
Figure 9B:
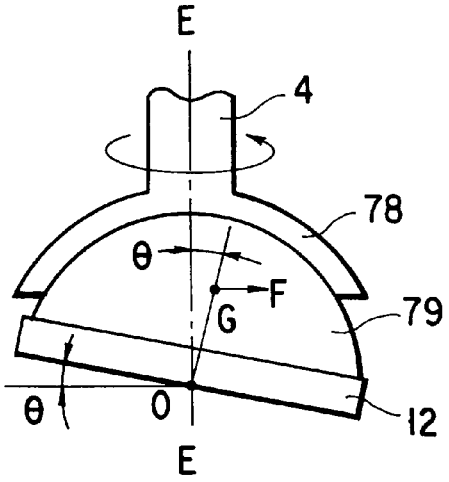
FIG. 9B (PRIOR ART)
FIG. 9B is a view for explaining the influence of centrifugal force upon the tilting portion in a conventional headstock.

First of all, we will explain the influence of centrifugal force upon a conventional headstock with reference to FIGS. 9A and 9B.

FIG. 9A shows how to tilt the holding plate in the conventional headstock. A flange portion 78 is formed on the distal end of the spindle 4. A spherical seat (radius r) is formed in the lower surface side of the flange portion 78. In the spherical seat, a hemispherical body 79 is placed. The hemispherical body 79 slides along the spherical seat. The holder plate 12 is attached to the lower side of the hemispherical body 79.

In such a headstock, the center of the spherical seat is an intersection O of the rotation axis E—E of the spindle 4 with the pad surface. At the neutral state, the center of gravity G of the holder plate 12 is present on the rotation axis E—E, right above the point O as shown in FIG. 9A. When the holder plate 12 tilts by an angle θ (as shown in FIG. 9B), the center of gravity G moves to a position which is away from the rotation axis E—E by a distance of OG·sinθ in the horizontal direction. When the holder plate 12 rotates, centrifugal force F is applied to the tilting portion (holder plate 12 and a hemispherical body 79) in the horizontal direction. The moment due to the centrifugal force F works on the tilting portion to increase the angle θ. The larger the degree of tilting, the longer the distance between the rotation axis E—E and the center of gravity G. Since the centrifugal force F increases in proportion to the distance between the rotation axis E—E and the center of gravity G, the moment is increased. As a result, the holder plate tilts more. Since the moment due to the centrifugal force F works on the tilting portion to tilt the holder plate, once the tilting occurs during the polishing operation, the holder plate tilts gradually and finally fails to trace the pad surface.

Figure 10A:
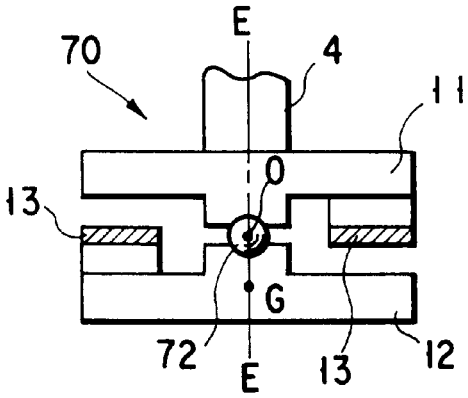
FIG. 10A is a view for explaining the influence of centrifugal force upon the tilting portion in the headstock of the present invention.
Figure 10B:
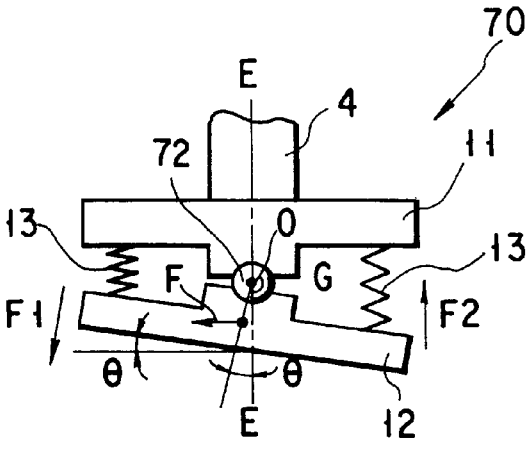
FIG. 10B is a view for explaining the influence of centrifugal force upon the tilting portion in the headstock of the present invention.

Next, we will explain the influence of centrifugal force upon the headstock of the present invention shown in FIG. 8, with reference to FIGS. 10A and 10B.

At the neutral position, the center of gravity G of the holder plate 12 is present on the rotation axis E—E right below the center of tilting O. In this state, ...individual connecting members 13 (plate springs) are in the same deformation. Therefore, the moment working on the holder plate 12 from the connecting member is canceled with each other, as a whole. When the holding plate 12 tilts by an angle θ as shown in FIG. 10B, the center of gravity G horizontally moves to a position, which is away from the rotation axis E—E by OG·sinθ. As a result, centrifugal force F works on the holder plate 12 in the horizontal direction. At the same time, the force working on the holder plate 12 from the connecting member 13 loses its balance and a restoring force is then produced. The restoring force is one which works to return the posture of the holding plate 12 to the neutral state.

In FIG. 10B, the restoring force is schematically indicated by F1 and F2 (spring force). Force F1 works downwardly on the holder plate 12 on the side in which the supporting plate 11 and the holder plate 12 are spaced at a narrow interval as a result of the tilting of the holder plate 12. Whereas, force F2 works upwardly on the side in which they are spaced at a large interval.

As described in the foregoing, the centrifugal force F applied to the holder plate 12 acts as the moment of accelerating the tilting. Whereas, the restoring force produced by the deformation of the connecting member 13 acts as the moment of restoring the holder plate 12 to the neutral posture. As a whole, the influence of the centrifugal force F is relatively lowered. Then, if the connection member 13 having a large spring coefficient is used to render the restoring forces (F1 and F2) larger than the centrifugal force F, the centrifugal force F seems to have no influence upon the holder plate by appearance. However, if the spring coefficient is excessively large, the holder plate does not tilt smoothly.

As apparent from the FIG. 10B, if the center of tilting O does not coincide with the center G of gravity of the holder plate, the moment due to the centrifugal force F is produced by tilting of the holder plate. In other words, if the center of tilting O coincides with the center of gravity G of the holder plate 12, the holder plate is free from the influence of the centrifugal force F.

Embodiment 7

Figure 11:
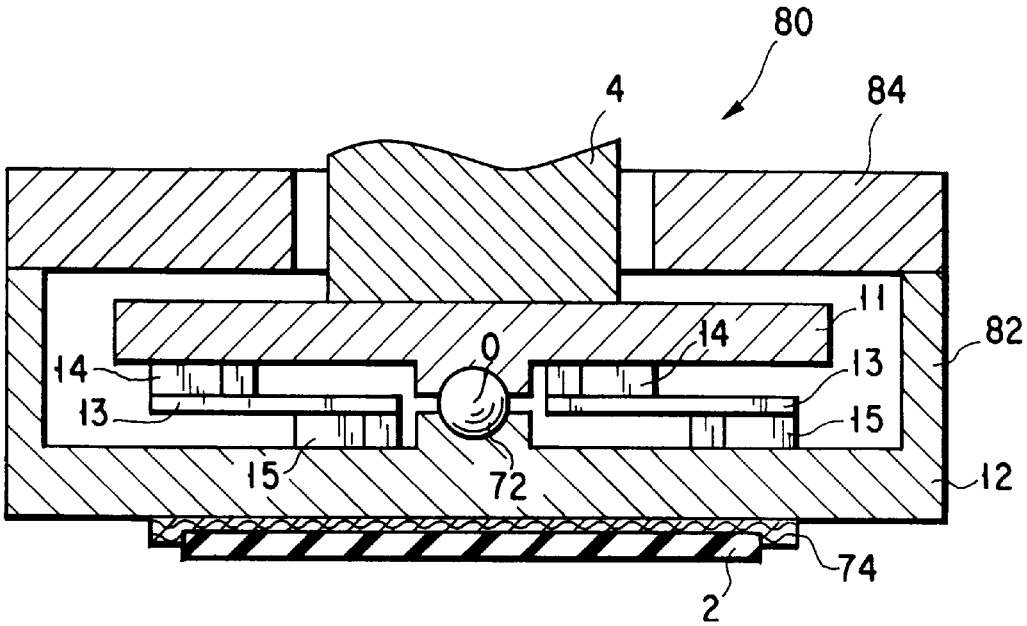
FIG. 11 is a cross-sectional view of another headstock according to the present invention in which the center of the gravity of the holder plate coincides with the center of tilting of the holder plate.

FIG. 11 shows a seventh embodiment of the headstock of a polishing machine according to the present invention.

The headstock 80 shown in FIG. 11 is a modification of the headstock previously shown in FIG. 8. In the headstock 80, the center of tilting O is allowed to coincide with the center of gravity of the holder plate 12.

Two spherical seats facing each other, are formed at the center of the lower surface of the supporting plate 11 and at the center the upper surface of the holder plate 12, respectively. A steel ball 72 is placed in the space surrounded by the two spherical seats. The center of the ball 72 is on the extension line of the rotation axis of the spindle 4 and corresponds to the center of tilting O of the holder plate 12.

A cylindrical portion 82 is formed on the periphery portion of the holder plate 12. A balance plate 84 is attached on the upper end of the cylindrical portion 82. The center of gravity of the tilting portion (the holder plate 12 including the balance plate 84) is allowed to coincide with the center of tilting O by controlling the shape and weight of the balance plate 84.

Since the center of the gravity coincides with the center of tilting O, the influence of the centrifugal force upon the tilting portion can be eliminated. As a result, the holder plate 12 can tilt smoothly.

Embodiment 8

Figure 12:
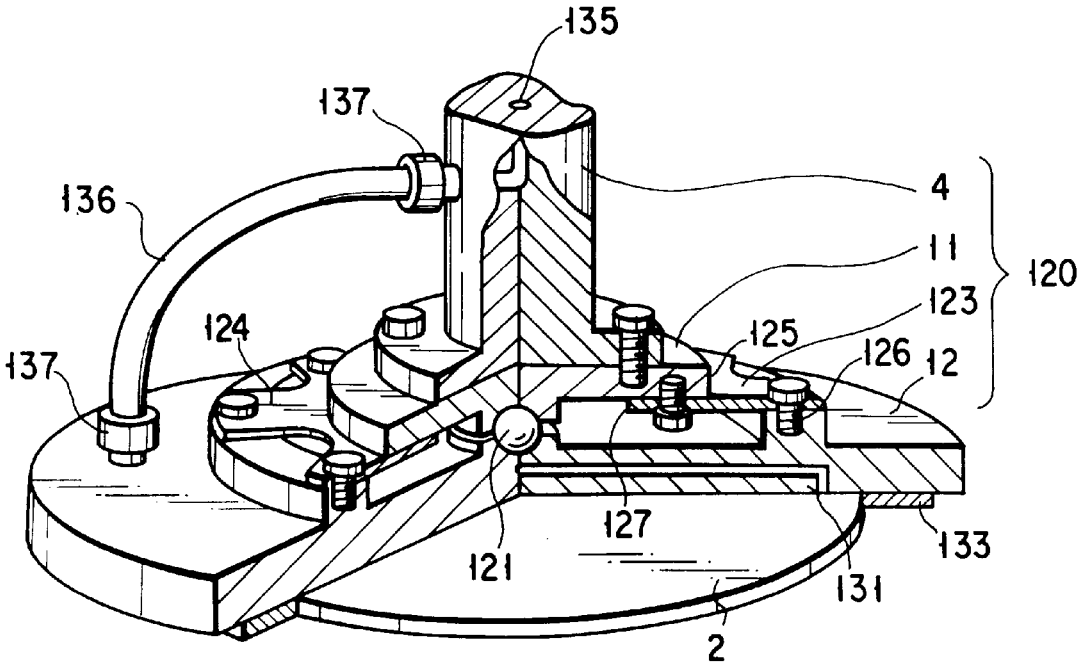
FIG. 12 is a cross-sectional view of another headstock according to the present invention in which a steel ball and a plate spring are used as a connecting member.

FIG. 12 shows an eight embodiment of the headstock of a polishing machine according to the present invention.

A spindle 4 is connected to a rotation driving mechanism (not shown), which is attached to the polishing machine. A supporting plate 11 is fixed to the lower end portion of the spindle 4. The holder plate 12 is attached to the lower surface side of the supporting plate 11 via a steel ball 121 and a plate spring 123.

A flat-plate workpiece 22 of this embodiment is attached to the lower surface of the holder plate 12 by vacuum chuck herein. Hence, vacuum adsorption holes 131 are formed inside the holder plate 12. The vacuum adsorption holes 131 are connected to a passage 135 (formed inside the spindle 4) by way of a coupling 137, and a pipe 136 (formed outside of the holder plate 12). Note that the pipe 136 is made of a flexible material since it must move together with the holder plate 12 when the holder plate 12 tilts. The lower surface of the holder plate 12 is provided with a guide 133 to fit the workpiece 2 at a right position.

Two spherical seats are respectively provided at the center of the lower surface of the supporting plate 11 and at the center of the upper surface of the holder plate 12. A steel ball 121 is placed at a space surrounded by the spherical seats. The center of the steel ball 121 is present on the rotation axis of the spindle 4. The tilting center of the holder plate 12 coincides with the center of the steel ball 121.

The holder plate 12 and the supporting plate 11 are connected to each other with the steel ball 121 and the plate spring 123 interposed between them. The plate spring 123 is an axisymmetrical. It has an opening portion 127 at the center and arms 124 in the outer periphery. The arms 124 extend along the diameter. A plurality of fitting holes 125 are formed along the inner periphery of the plate spring 121. The plate spring 123 is fixed to the lower surface of the supporting plate 11 by inserting a bolt in the fitting hole 125. The distal end portion of each arm 124 is also provided with a fitting hole 126. The plate spring 123 is fixed to the upper surface of the holder plate 12 by inserting a bolt in the fitting hole 126.

The fitting holes 126 and the fitting holes 125 are arranged on a large-diameter circle and a small-diameter circle, respectively. Both circles are arranged concentrically around the rotation axis of the spindle 4. The holder plate 12 can be tilt equally around two axis perpendicular to the rotation axis.

The holding plate 12 can be tilted around two axis perpendicular to the spindle 4 by the presence of the spherical bearing 121. The pressure from the spindle 4 is transmitted to the holder plate 12 via the supporting plate 11. At the same time, the rotation torque is transmitted from the spindle 4 to the holder plate 12 via the plate spring 123.

Hence, if the rigidity of the plate spring 123 is controlled while maintaining the rotation torque within the predetermined range, it is possible to prevent non-uniform contact of the workpiece 2 with the pad surface. As a result, the flatness of the workpiece can be improved.

In this headstock 120, the holder plate 12 is connected to the spindle 4 via the supporting plate 11 by use of the steel ball 121 and the plate spring 123. The plate spring 123 used herein is formed axis-symmetrically. Hence, not only the supporting plate 11 but also the seats formed on the sides of the supporting plate 11 and the holder plate 12 can be formed in relatively simple shape. Consequently, the headstock can be miniaturized and rendered thin and light. In particular, light-weight tilting mechanism is effective in improving the tilting movement.

Plate springs 123 to be used in the headstock of the present invention (different in shape) will be shown in FIGS. 13A to 13D.

The plate spring shown in FIG. 13A has the same axis-symmetrical shape as used in FIG. 12. It has an opening 127 at the center and four arms 124 in the outer periphery. The arms 124 extend along the radial direction. Four fitting holes 125 are formed along the inner periphery of the lead spring 123. The distal end portion of each arm 124 is provided with a fitting hole 126. The fitting holes 125 and 126 are used to connect the supporting plate 11 to the holder plate 12, respectively. The number of the arms 124 is appropriately selected in consideration of symmetric characteristic, rotation torque to be transmitted, and restoring force against tilting. It is generally preferred to use three to eight of the arms.

The plate spring shown in FIG. 13B is a disk-form plate spring which has an opening 127 at the center and six slits 128. The slits extend along the diameter from the outer periphery to the center. The portion between adjacent slits 128 corresponds to an arm 124.

The disk-form plate spring is relatively easily formed.

In the headstock of the present invention, the lower the rigidity of the plate spring 123, the smaller the force required for tilting the holder plate 12.

As a result, the tilting characteristics of the holder plate 12 can be improved sufficiently to trace the pad surface. The shapes of the arms 124 can be modified to improve the tilting movement. Examples of the shapes are shown in FIGS. 13C and 13D.

In FIG. 13C, each arm 124 is formed of two portions extending diagonally relative to the radius direction. The two portions are combined at each of the distal end portions, thereby forming an opening portion 130 at the center of each arm 124. The plate spring shown in FIG. 13D is characterized in that each arm 124 has upper and lower folding portions 129. The view of FIG. 13E is a cross sectional view of the plate spring 124. When the plate spring shown in FIG. 13C or 13D is used and fit by the fitting holes 125 and 126 formed at the same position as those shown in FIG. 13A, actual length of the arm 124 in this case is longer than that shown in FIG. 13A. In this case, assuming that the arms 124 (FIGS. 13C and 13D) have the same total width as that shown in FIG. 13A, the holder plate can be tilted by a smaller force than that of FIG. 13A. More specifically, the tilting movement can be improved without lowering twisting strength in the circumference direction.

Embodiment 9

Figure 14:
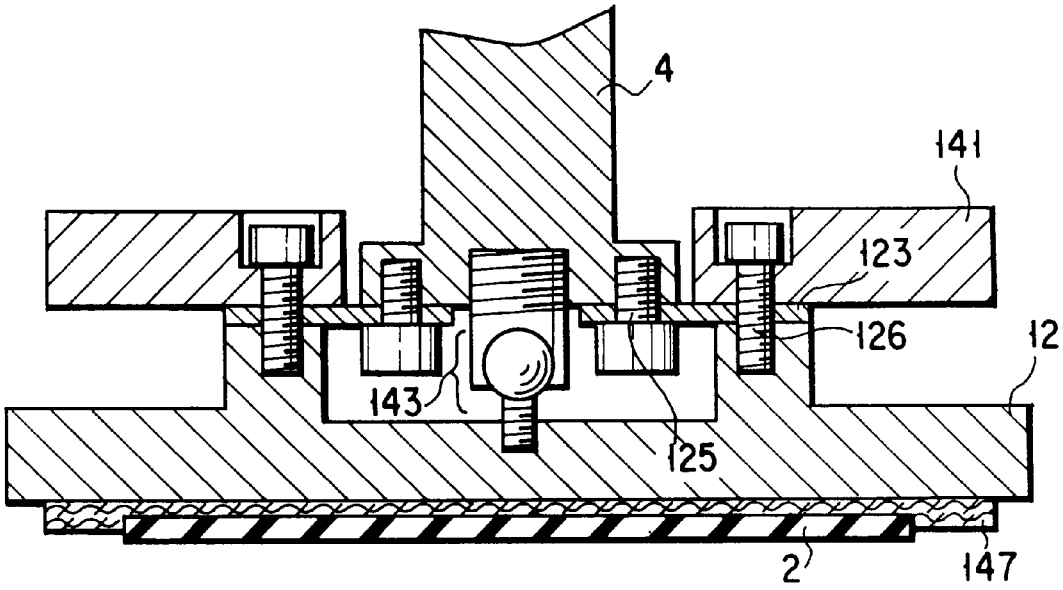
FIG. 14 is a cross-sectional view of a still other headstock of the present invention in which the holder plate is provided with a balance plate.
Figure 15:
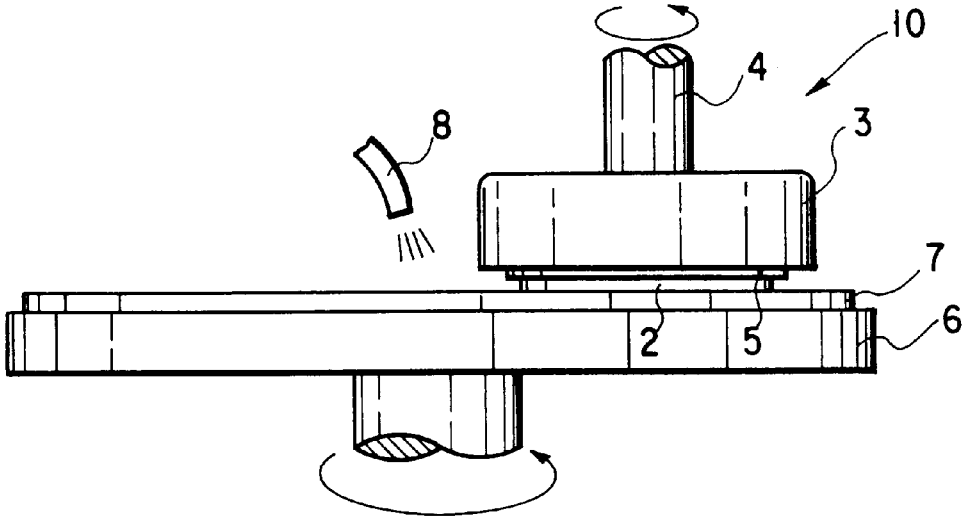
FIG. 15 (PRIOR ART)
FIG. 15 is a cross-sectional view of a conventional-used headstock.

FIG. 14 shows a ninth embodiment of the headstock of a polishing machine according to the present invention.

In this embodiment, a spherical bearing 143 is used instead of the supporting plate 11 as shown in FIG. 12. The spherical bearing 143 is connected directly to the lower end portion of the spindle 4. The fitting holes 125 (provided along the inner periphery of the plate spring 123) are also connected directly to the lower end portion of the spindle 4. The workpiece 2 used herein is attached to the holder plate 12 via a soft pad 147.

The upper surface of the holder plate 12 is provided with a ring-form balance plate 141 so as to surround the spindle 4. The center of gravity of the holder plate 12 (including the balance plate 141) moves upward by the presence of the balance plate 141. If the shape and weight of the balance plate 141 are appropriately chosen, the center of gravity of the holder plate 12 can coincide with the center of tilting of the spherical bearing 143.

If the center of gravity of the holder plate 12 does not coincide with the center of tilting of the spherical bearing 143, centrifugal force is generated when the holder plate 12 tilts relative to the spindle by rotating it at relatively high speed. The magnitude of the centrifugal force is in proportional to the weight of the holder plate 12, the distance between the rotation axis and the center of gravity of the holder plate 12, and the rotation speed. An angle of tilting is increased by the centrifugal force thus generated. As a result, tilting movement is not appropriately performed. On the other hand, when the holder plate 12 is tilted relative to the spindle by rotating it at relatively lower speed, a restoring force due to the weight of the holder plate 12 is generated. Since the restoring force reduces the degree of tilting, tilting movement is not performed appropriately, either.

If the center of gravity of the holder plate 12 coincides with the center of tilting of the spherical bearing 143 by use of the balance plate 141, as shown in FIG. 14, or if the distance between the holder plate 12 and the spherical bearing 143 is reduced, it is possible to suppress the generation of centrifugal force and restoring force. If so, the tilting movement of the holder plate 12 can be improved sufficiently to trace the pad surface.

The headstock shown in FIG. 14 has a relatively simple structure. Therefore, the headstock can be miniaturized and lightened. At the same time, the headstock thus obtained exhibits excellent tilting performance. It is therefore possible to obtain a miniaturized and light-weight polishing machine.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

We claim:

1. A headstock of a polishing machine for holding and rotating a flat-plate workpiece, comprising:

a spindle connected to a rotation driving mechanism;

a supporting plate connected to a lower end of said spindle;

a holder plate arranged in parallel to said supporting plate on a lower side of said supporting plate, and having the workpiece on a lower side of the holder plate; and a plurality of plate springs, which are arranged at equal intervals on the circumference of a circle having a center on a rotation axis of said spindle, and a longitudinal direction of each of said plate springs is parallel to a tangent line to said circle, a thickness direction thereof is perpendicular to a surface of the workpiece, and an end of each plate spring is fixed on said supporting plate, whereas the other end of each plate spring is fixed on said holding plate.

2. A headstock of a polishing machine for holding and rotating a flat-plate workpiece, comprising:

a spindle connected to a rotation driving mechanism;

a supporting plate connected to a lower end of said spindle;

a holder plate arranged in parallel to said supporting plate on a lower side of said supporting plate, and having the workpiece on a lower side of the holder plate; and a plurality of connecting members, each being formed of a rigid member and elastic bodies which are provided on both ends of said rigid member, said connecting members being arranged at equal intervals on the circumference of a circle which has a center on a rotation axis of said spindle, a longitudinal direction of each of said connecting members is parallel to a tangent line to said circle, and one end of said rigid member is connected to said supporting plate via one of said elastic bodies, whereas the other end of said rigid member is connected to said holder plate via the other of said elastic bodies.

3. A headstock of a polishing machine for holding and rotating a flat-plate workpiece, comprising:

a spindle connected to a rotation driving mechanism;

a supporting plate connected to a lower end of said spindle;

a holder plate arranged in parallel to said supporting plate on a lower side of said supporting plate, and having the workpiece on a lower side of the holder plate; and a ring-shaped plate spring which is fixed on said supporting plate at positions spaced at equal intervals on the circumference of a circle having a center on a rotation axis of said spindle, and which is also fixed on said holder plate at positions which are shifted in the circumferential direction of said circle from said positions by a predetermined distance.

4. The headstock according to any one of claims 1 to 3, further comprising a pressure transmitting block for transmitting pressure from said supporting plate to said holder plate, said pressure transmitting block being arranged on an extension line of a rotation axis of said spindle between said supporting plate and said holder plate.

5. The headstock according to claim 4, wherein said pressure transmitting block is formed of an elastic body.

6. The headstock according to claim 4, wherein said pressure transmitting block is a rigid ball, and spherical seats are formed at the center of a lower surface of said supporting plate and at the center of an upper surface of said holder plate for holding said rigid ball.

7. The headstock according to claim 6, wherein the center of gravity of said holder plate coincides with the center of said rigid ball.

* * * * *